US006293564B1

(12) United States Patent
Gabrielli

(10) Patent No.: US 6,293,564 B1
(45) Date of Patent: Sep. 25, 2001

(54) IN-LINE ROLLER SKATE

(75) Inventor: Andrea Gabrielli, Predatto (IT)

(73) Assignee: Tecnica SPA, Treviso (IT)

( * ) Notice: Subject to any disclaimer, the term of this patent is extended or adjusted under 35 U.S.C. 154(b) by 0 days.

(21) Appl. No.: 09/192,332

(22) Filed: Nov. 16, 1998

(30) Foreign Application Priority Data

Nov. 27, 1997 (IT) ..... TV97A0166

(51) Int. Cl.[7] ..... A63C 17/06; A43B 5/18

(52) U.S. Cl. ..... 280/11.224; 280/11.3; 36/115

(58) Field of Search ..... 280/11.3, 11.31, 280/11.32, 11.19, 11.221, 11.224; 36/115, 118.2, 119.1

(56) References Cited

U.S. PATENT DOCUMENTS 5,848,796 * 12/1998 Meibock et al. ..... 280/11.22
5,913,526 * 6/1999 Olson et al. ..... 280/11.22
5,924,706 * 7/1999 Seltzer et al. ..... 280/11.31
6,000,704 * 12/1999 Balbinot et al. ..... 280/11.3

FOREIGN PATENT DOCUMENTS 0780062 6/1997 (EP) .
97/18725 5/1997 (WO) .

* cited by examiner

*Primary Examiner*—Lanna Mai
*Assistant Examiner*—Jeff Restifo

(57) ABSTRACT

An in-line roller skate, which comprises a rigid shell wherein a flexible inner shoe is housed.

The latter is advantageously lined at the level of its leg portion by a cover, thereby defining with it a sheath substantially open downward in which the upper part of the shell is housed.

In this way, when the skater's ankle bends forwards it is supported by the inner shoe as a result of the interference arising between the cover and the upper part of the shell. This allows a great freedom of movement in a longitudinal direction for the skater's ankle, which can be bent even in a very accentuated manner, differently from what occurs in the known skates, where the bottom of the leg is enclosed in a rigid leg portion.

At the same time, good support is maintained in a lateral direction owing to the upper part of the shell which allows the transmission of the guiding movements. According to a preferred embodiment, the cover may be hinged to the shell in the malleolar regions.

8 Claims, 8 Drawing Sheets

IN-LINE ROLLER SKATE

BACKGROUND OF THE INVENTION

FIELD OF THE INVENTION

The present invention refers to skates with aligned wheels, that is to say those skates widely used nowadays and also known by the English naming "in-line" skates.

As is known, these skates consist basically of a frame supporting the wheels according to the particular in-line arrangement mentioned above, and a boot fitted onto such frame.

Considering the current prevailing commercial trends, it is possible to divide the aforesaid skates on the basis of the type of boot mounted on the frame; in particular it is possible to distinguish two distinct categories of skates: those with rigid boots and those with soft boots.

In the first of said classes the boot consists of a rigid shell, generally made from plastic material, which includes a sole that represents the part of the boot fixed to the frame; on the shell there is hinged, with bosses or pins, a leg portion which defines the upper part of the boot.

Also the leg portion is made from plastic material like that of the shell and together with the latter they enclose a padded inner shoe, in which the skater's foot is comfortably accomodated. In order to assist the ventilation of the foot it is also known to provide in the shell and/or the leg portion, openings that allow the passage of air.

In the second class of skates instead of the rigid shell described above there is a shoe with a flexible upper made preferably from synthetic fabric; the shoe is fixed by means of adhesive or other suitable systems to a rigid support or abutment which is located in the region of the heel, as well as to a toe-piece also rigid located at the tip: both the abutment and the toe piece are solid with a sole fitted onto the frame.

The abutment of these skates extends up to the level of the malleoli and a rigid leg portion of the type used for the rigid boots already mentioned above, is hinged on it; however, differing from what occurs in the other type of skates, the flexible upper per se allows a good transpiration and ventilation of the foot and there is therefore no need to arrange specific openings on it for this purpose.

Examples of skates produced according to this last teaching are known from International Patent Application No. PCT/FR96/01618 in the name of Salomon, and from European Patent Application No. 0 780 062 in the name of Nordica, both already published. In practice the principal difference between the respective skates to which these two applications refer, lies in the fact that in the first one the flexible upper finishes slightly above the hinging points of the rigid leg portion, which therefore has its own independent inner padding, whereas in the second one the flexible upper extends up to the calf (the inner shoe is therefore similar to an ankle-boot) so that a rigid leg portion hinged to the abutment can be fitted externally thereof.

In general it may be stated that the rigid boots provide greater immediacy in the control transmission from the foot to the skate, while the soft boots offer greater comfort; consequently the former are more suitable for skates in which greater manoeuvrability is required, whereas the latter are more suitable where a higher degree of comfort is preferred.

There are however situations in which neither type of skates is capable of satisfactorily obtaining the performances demanded of them.

For example there are cases wherein the skater makes large movements, such as during long duration competition, in the course thereof the legs of the athlete describe a wide stride for which the ankle must be able to be bent in an accentuated manner; on such occasions neither the skates with rigid boots nor those with soft boots can provide adequate freedom of movement for the ankle and ensure in the meantime the necessary effect of containing and supporting the foot for correct skating.

In both cases indeed the rigid leg portion inevitably limits the flexing of the ankle, since it fits closely round the bottom of the leg with respect to which, in its rotations about the hinging pins, it assumes positions that increasingly diverge as the inclination of the ankle increases.

Such divergence causes interference and friction between the skater's leg and the leg portion of the boot, which cannot be tolerated for prolonged periods, as in the case of the long duration competitions mentioned above, since they cause painful stresses in the athletes and limit their performances.

SUMMARY OF THE INVENTION

The object of the present invention is therefore that of providing a remedy to such a situation.

In other words, the invention aims at providing an in-line roller skate in which the boot is suitable for complying with the movements of the lower part of the leg, especially in the case of wide flexions of the ankle.

This object is achieved by a skate whose characterising features are stated in the claims annexed to this description.

BRIEF DESCRIPTION OF THE DRAWINGS

For a better understanding of the invention as a whole, with its features and the advantages deriving therefrom, a detailed description will now be given of exemplary and non-limiting embodiments thereof illustrated in the appended drawings, wherein.

DETAILED DESCRIPTION OF THE PREFERRED EMBODIMENTS

Figure 1:
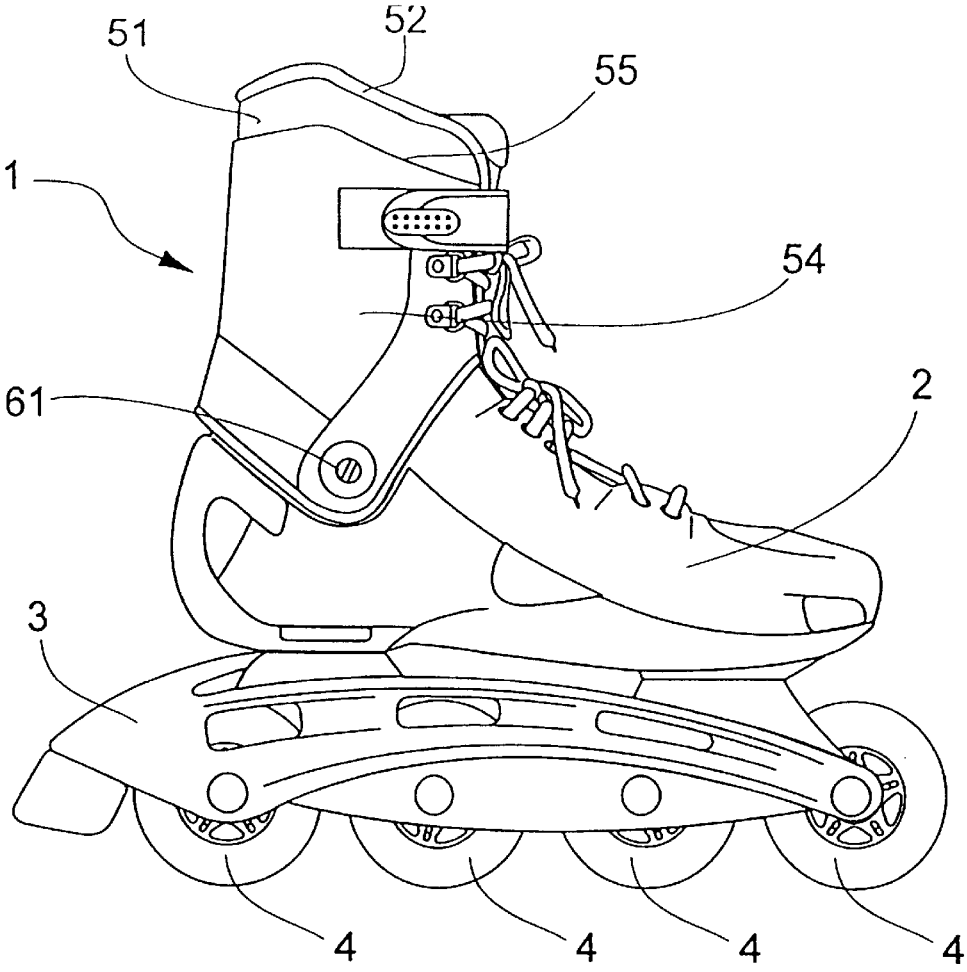
FIG. 1 is a side view of a skate according to an embodiment of the invention.

In the figures listed above, the reference 1 indicates as a whole an in-line roller skate according to the invention.

This skate consists of a rigid shell 2, made from plastic material of the type already known per se and used in the art for manufacturing the shells of the skates, fixed on a frame 3 wherein the wheels 4 are mounted; a soft inner shoe 5 is accomodated in the shell, from which it projects upward as it will better result later. Using the same terminology of the previous description of the state of the art, it could be said that the shell 2 and the inner shoe 5 in this case form the boot of skate 1.

With regard to the frame 3 and the wheels 4, these are also of a type already known per se and therefore they will not be described in greater detail here; reference should be made for this purpose to what exists in the current applications.

The shell 2 is shaped basically like a boot which ends slilghtly above the level of the malleoli of the skater's foot; the shell has a sole 20 fixed to the frame 3 at two different points, that is to say, in the region of the heel and in that of the tip, optionally by fixing means which allow adjustment of the position of the shoe with respect to the frame.

Figure 4:
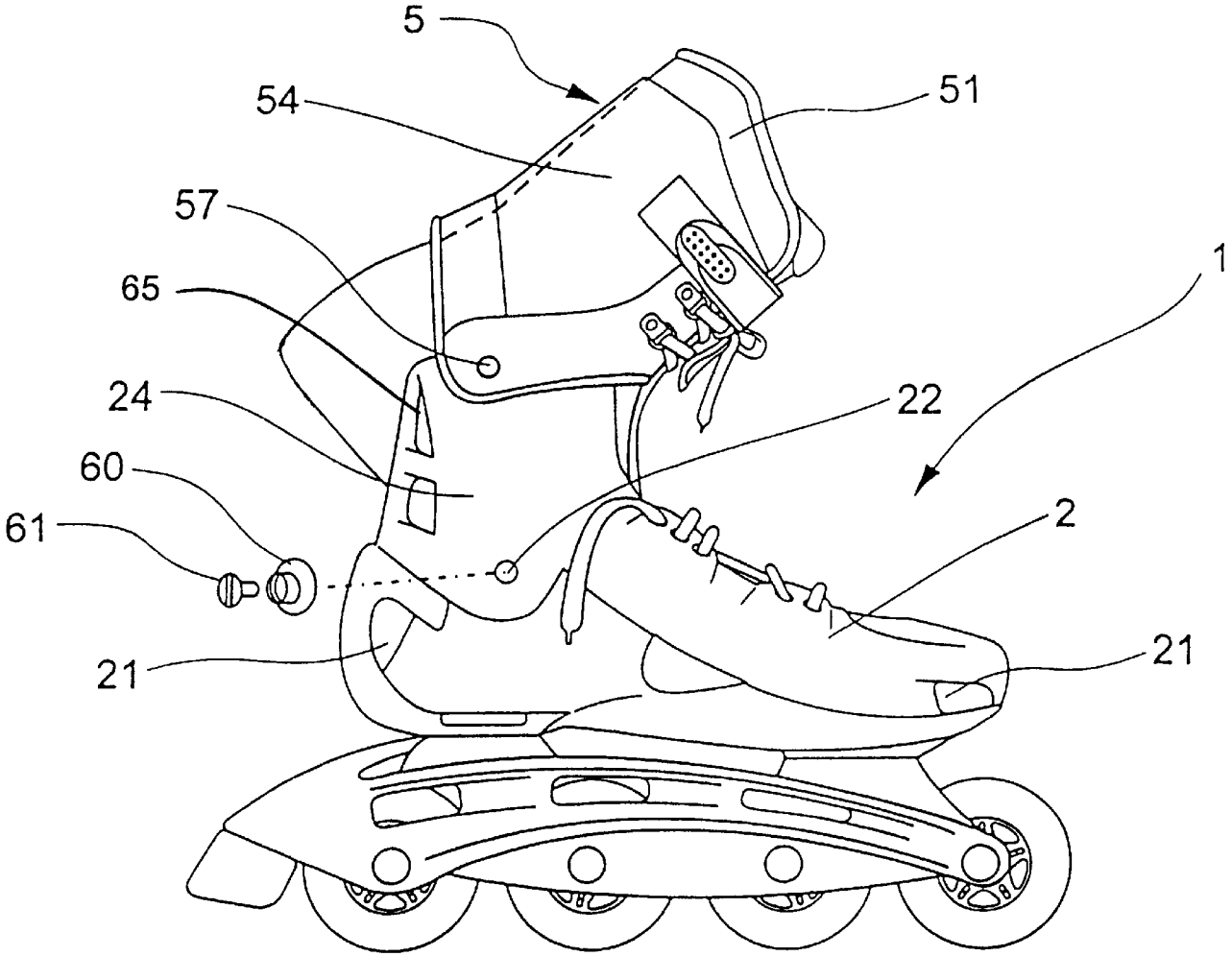
FIG. 4 shows a side view of the coupling of the parts of the skate shown in FIGS. 2 and 3.
Figure 6A:
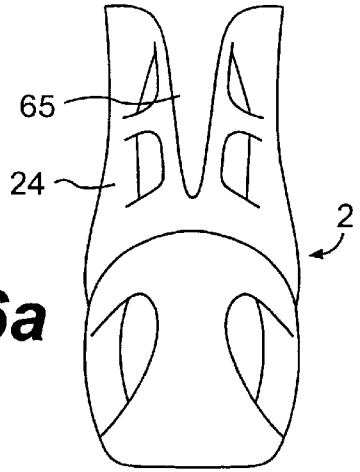
FIGS. 6*a*–6*d* show a skate shell according to an embodiment of the present invention.
Figure 6B:
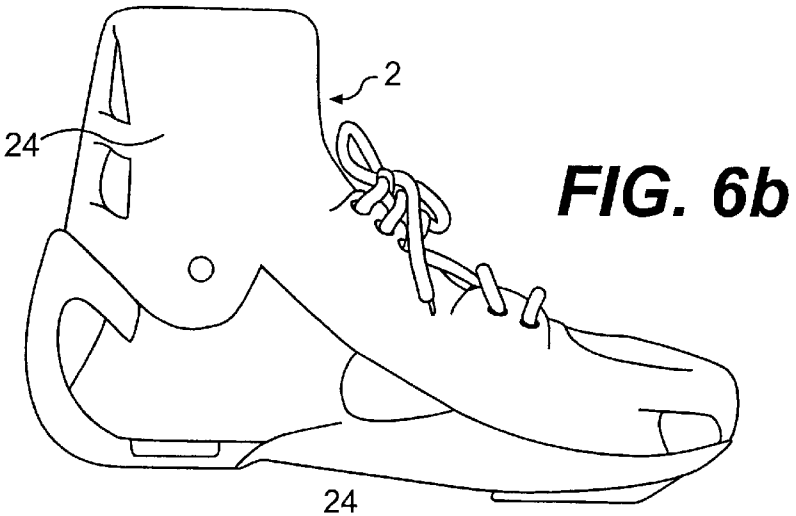
Figure 6C:
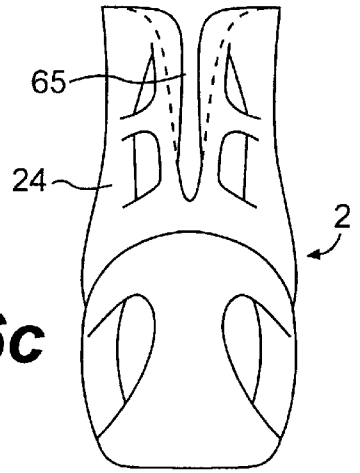
Figure 6D:
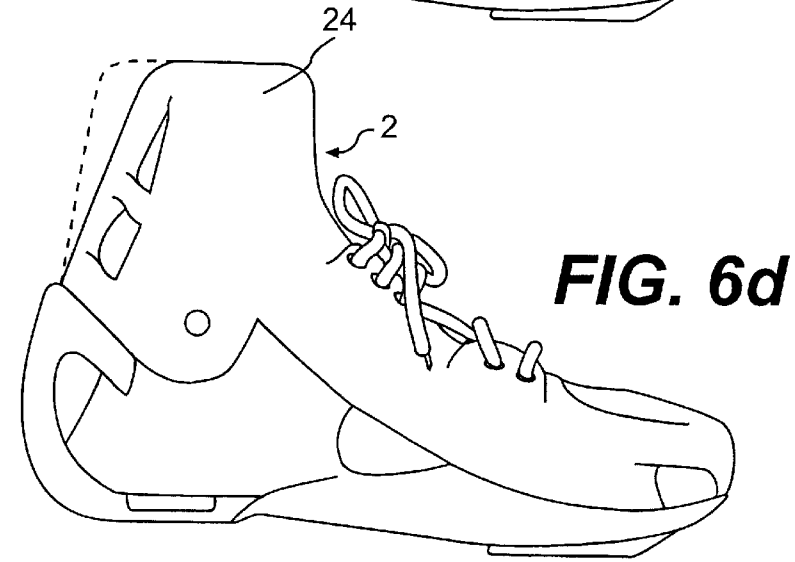
Figure 7:
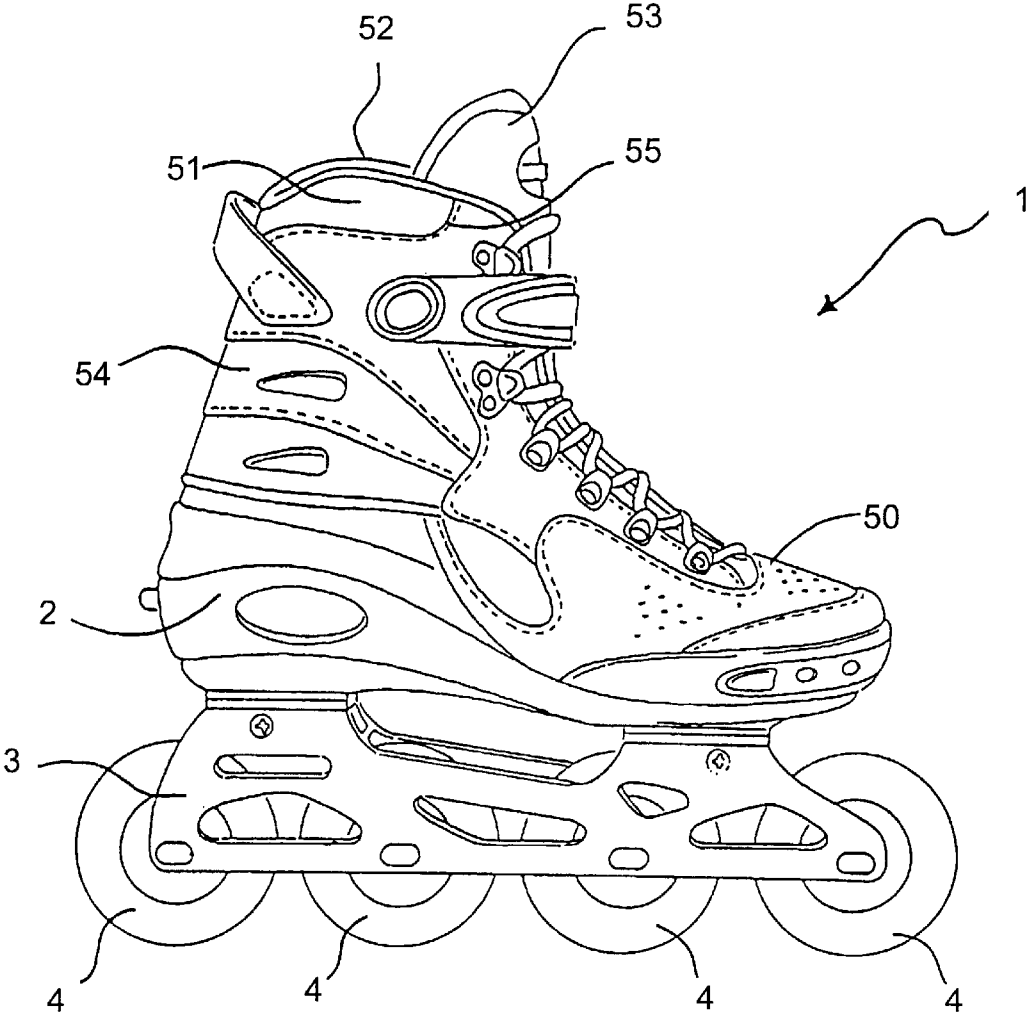
FIG. 7 shows a side view of a skate according to another embodiment of the present invention.
Figure 8:
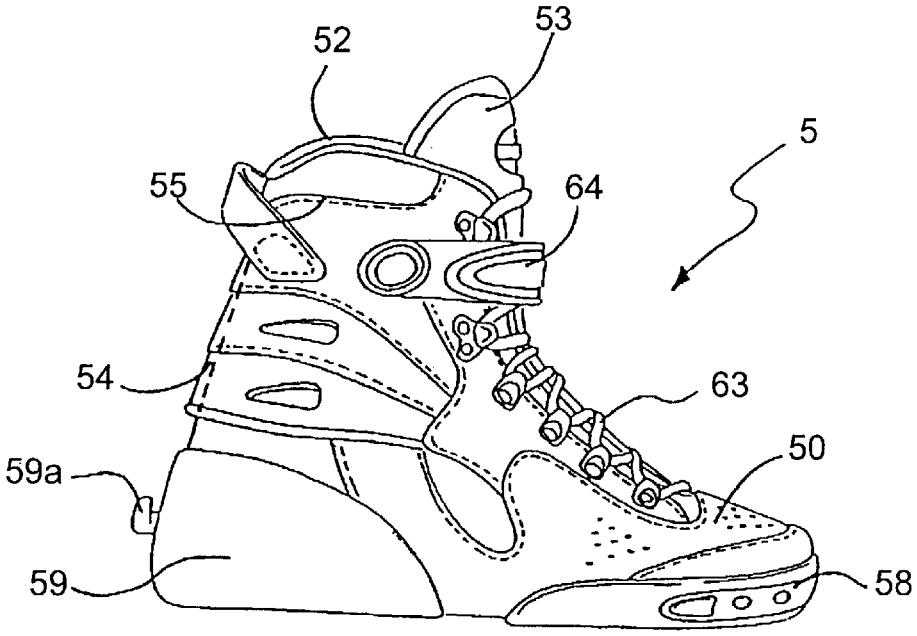
FIGS. 8 and 9 show a side view of respective parts that constitute the skate in FIG. 7.
Figure 9:
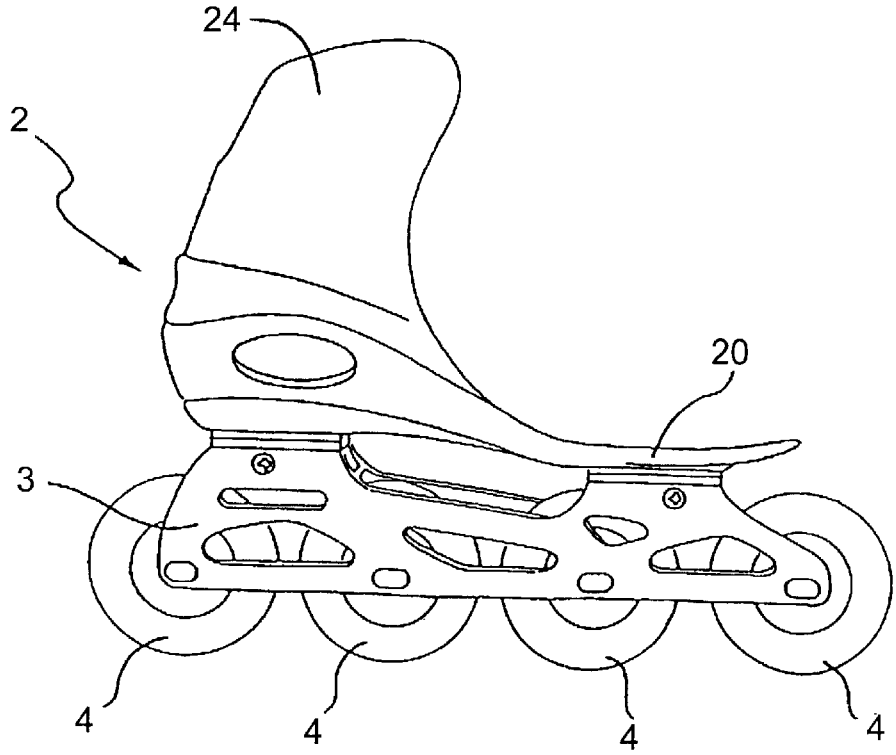

The shell 2 is also provided at the rear with a notch 65 which confers a certain flexibility (see FIGS. 6*a*–6*d*) and makes it possible to introduce the inner shoe 5 easily from behind, as shown in FIG. 4.

In the shell 2 ventilation openings 21 are also formed according to the known teaching in the art, while in the malleolar regions of the a housed in the skate there are two holes 22 (only one of these is visible in the drawings) opposed to one another with respect to a median longitudinal plane of the skate passing through the aligned wheels; the function of said holes will be explained more clearly hereinafter.

For tightening the shell 2 around the skater's foot, in this example a closure with laces 23 has been used; it is clear, however, that such a closure may be replaced by other systems, such as hooks, strips of Velcro (Reg. trademark) and the like.

The inner shoe 5 contained in the above-mentioned shell comprises an upper 50 of soft material which is closed at the bottom by a sole (not shown in the drawings) and is provided above with a leg portion 51 which ends with an edge 52; the inner shoe 5 also comprises a padded tongue 53 arranged in the front of it.

The leg portion 51 of the inner boot is externally lined with a flexible cover 54, which is attached to it (for example by sewing) along a line 55 located slightly below the upper edge 52, with respect to which it extends substantially parallel.

As can be observed in the drawings, between the cover 54 and the outer surface of the leg portion 51 there is defined a sheath (similar to an air space) for housing an upper part 24 of the shell 2, that is to say a part located mainly above the malleolar region and which will be appreciated more clearly in the continuation of this description.

On the cover 54 there are also formed two slots 57 in a position corresponding to that of the holes 22 on the shell; said slots and holes are intended for receiving means for hinging the cover 54 to the shell, in this example consisting of a bush 60 having an internal screw thread and provided with a flattened head, associated to a screw 61.

The inner shoe 5 is finally completed by a closure system 23 with laces 63 and Velcro (Reg. trademark) 64 which, when the inner shoe is inserted into the shell 2, is located above the closure laces 23 of the latter; obviously also this closure system may be substituted by others equivalent according to the most varied alternatives.

For assembling the skate 1, the shoe 5 is introduced into the shell 2 in such a manner that the cover 54 remains outside the upper part 24 of the shell (see FIG. 4); as a consequence, the latter part is then housed in the sheath formed by aforesaid cover and the outer surface of the shoe 5.

Figure 5:
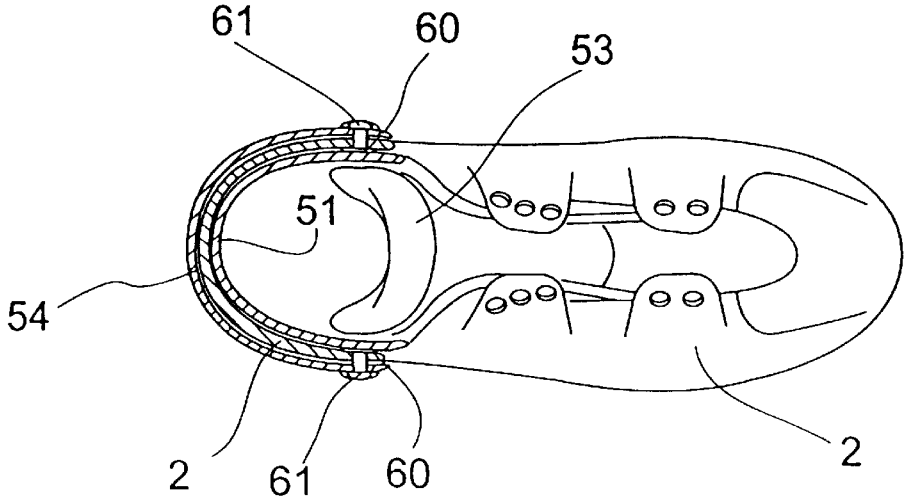
FIG. 5 is an elevational view partly sectioned, of the skate in FIG. 1.
Figure 2:
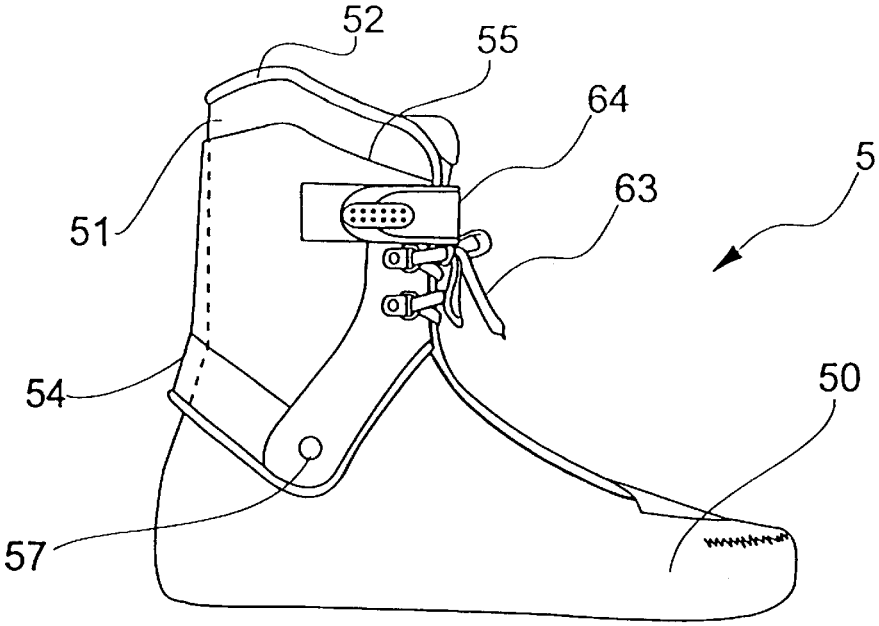
FIGS. 2 and 3 show a side view of respective parts that constitute the skate in FIG. 1.
Figure 3:
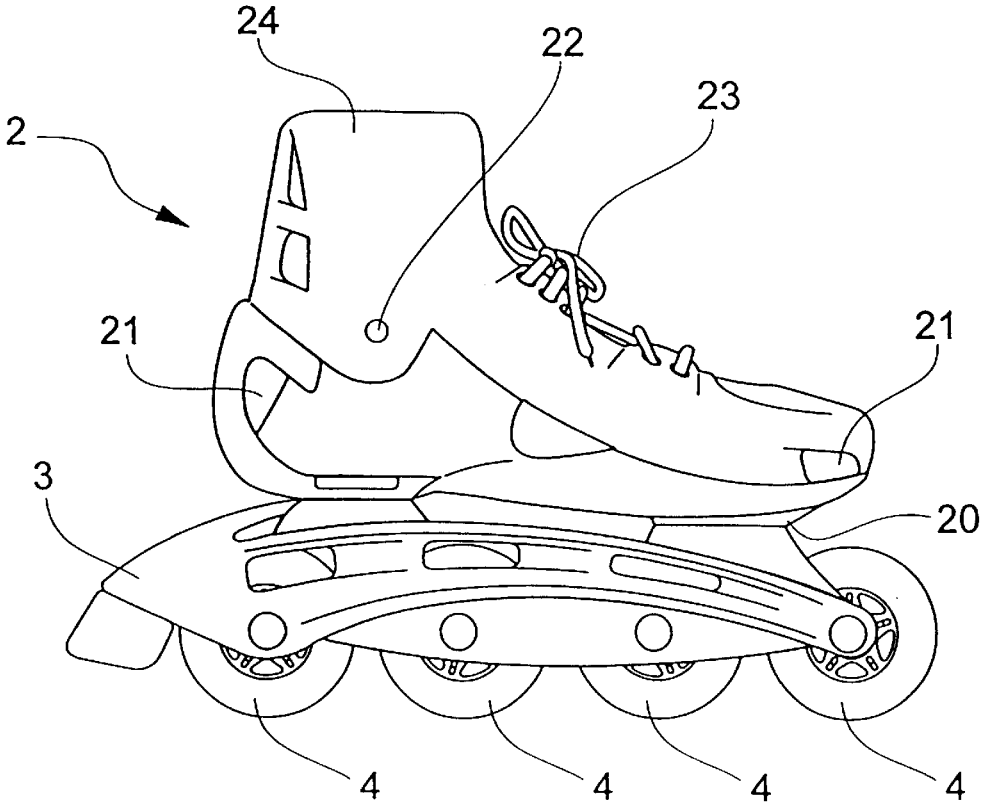

At this point the cover 54 can be hinged to the opposed sides of the shell 2, by means of the screws 61 and the bushes 60: indeed the bushes are introduced into the holes 22 from the inside of the shell and their flattened head serves as a backsight element against the wall (see the area in section in FIG. 5) of the shell, while their screw-threaded part passes through the holes 22 and the slots 57 of the cover so as to allow the fitting of the screws 61 from the outside.

It should be observed that in the skate of the present invention, the fact that the cover is hinged to the shell allows it to rotate with respect to an axis transverse to the skate itself, defined by the straight line which joins the hinging points and constituted in this case by the aforesaid screws and bushes.

The final condition assumed by the skate after its various parts have been assembled as described above, is shown in FIG. 1.

From what has been explained hitherto it is possible to understand how the invention achieves the object for which it is intended.

Indeed, owing to the cover 54 and to the particular arrangement of the upper part of the shell 2 which is housed in the sheath defined between the cover and the inner shoe 5, the bottom of the skater's leg is now supported in front by the shoe itself: there is now no need for any rigid leg portion like that present in the known skates already mentioned, as well as it is no more necessary to provide a particularly high, rigid shell which would moreover be uncomfortable and hinder the movements of the skater.

For better understanding these aspects reference should be made to the situation outlined before, in which the skater's ankle is bent in an accentuated manner: for this purpose reference should also be made to FIG. 1 and FIGS. 6*a*–6*d* that show a "rest" position of the skate, and starting therefrom imagine to bend the ankle as just mentioned: it is not difficult to understand that in such circumstances the leg portion 51 of the inner shoe 5 moves forwards (that is to say, towards the tip of the skate) facilitating the movement of the lower part of the leg.

Such movement cannot be hindered by the shell 2 because, as can be seen from the drawings (see FIG. 5), the shell is open at the front i.e. where the tongue 53 of the inner shoe 5 is located; this means that the ankle can be bent freely even with marked inclinations, just as desired for this application.

However, since the upper part of the shell is housed between the cover 54 and the exterior of the leg portion 51, the latter is retained in its forward movement by the interference which is produced between the cover 54 and the upper part of the shell 2. In other terms, it may be stated that the cover 54 allows relative movements between the shell and the leg portion, at the same time exerting a retaining action on the leg portion itself so as to support the front part of the leg when the ankle is bent.

It is in fact clear that the forward movements of the leg portion 51 of the inner shoe 5 should be limited to some extent, otherwise there would be a risk that the skater's leg is not supported adequately. In this connection the fact should not be overlooked that, as can also be seen from the drawings, the configuration of the rigid shell 2 is such as to support laterally and at the rear the articulation of the foot: indeed, as already stated the shell is open at the front in its upper part for facilitating the forward movements of the leg portion 51, but on the sides and at the rear it is formed in such a manner as to contain the ankle as required for skating.

It can therefore be stated that the skate of the present invention provides performances comparable to those of the other skates known at present, as regards the lateral and rear supporting of the lower part of the leg; however, it is superior in relation to the bending of the ankle, since it is able to adapt to the positions assumed by the lower part of the leg as explained.

It is not difficult to appreciate that these results have been obtained by eliminating the rigid leg portion which is present in the known skates; as stated at the beginning of this description, indeed, the rotation of said leg portion about fixed hinge points in the skate does not allow it to adapt to the lower part of the leg, when the ankle is markedly bent.

On the contrary, in the skate of the present invention the rigid leg portion has been completely eliminated, with all the clear advantages deriving therefrom; it is just to be said that the leg portion 51 of the inner shoe 5 is flexible and therefore does not provide any hindrance to the movements of the leg. Nor should it be overlooked that the leg portion 51 is not hinged to a fixed point as occurs with the rigid leg portions of the prior art: this allows to adapt it better to the various positions assumed by the skater's ankle.

Obviously, all these effects can be predetermined at the time of designing and manufacturing the skates, by suitably choosing the size of the sheath formed by the cover 54 and the leg portion 51, the materials of which the inner shoe 5 as well as the cover 54 and the shell 2 are made (indeed the resilience and the friction of the various materials may play an important role in obtaining the results which have been described), and other factors that may depend from case to case on the specific manufacturing forms of the skates.

In this context it should also be pointed out that the significant results obtained by the invention and referred heretofore, are improved in a surprising manner by hinging the cover 54 to the shell 2.

In some respects it may indeed be stated that the hinging of the cover, especially when effected in the region of the malleoli as in the case described, achieves the effect of guiding the movements of the leg portion 51 without however preventing the inner shoe 5 from complying in an optimal manner with the various positions assumed by the skater's ankle; it is clear in fact that the shoe inside the shell 2 remains free to deform itself by virtue of its flexibility (see FIGS. 6*c*–6*d*), so as to permit the flexing of the ankle as already stated.

It seems useful at this point to draw attention to the fact that European Patent Application No. 0 780 062 referred to above, describes a skate wherein a cover hinged to the abutment located in the region of the heel, is fitted round the rigid leg portion associated to the flexible inner shoe.

However, it is important not to be misled by this apparent similarity to the invention. Indeed, the cover indicated in this document has no functional purpose but has instead been provided for purely aesthetic reasons (to conceal the plastics of the rigid leg portion), in as much as its provision is referred to as optional (see column 2, lines 35–36 and 47–50) in the published text of the application.

From the analysis of this publication it is further not difficult to understand that the cover in question is solid with the rigid leg portion, which can rotate about its hinging points on the support or abutment located in the region of the heel; as a consequence, the cover does not interact in any way with the shell or with another fixed part of the skate, as occurs instead in the present invention.

Naturally, variations of the latter are possible with respect to the example thereof given heretofore.

As an indication it is not difficult to consider that the cover 54 may give rise to several alternative solutions; preferably it is indeed made from synthetic fabric or from leather or the like, possibly even elasticised, however the possibility should not be excluded of substituting it with meshes or other similar structures which, of course, attain the same effects already mentioned.

Also as regards the fixing of the cover to the leg portion it is possible to envisage changes.

In fact, the junction along the line 55 has the advantage of constituting a valid system for keeping the upper part 24 of the shell, stable in its position between the cover and the leg portion of the shoe 5; however it can be stated in more general terms that the methods of fixing the cover should principally allow the introduction and the housing of the shell, in accordance with what has already been explained: consequently, once these conditions are fulfilled any variant may be compatible, in principle, with the invention.

Likewise, the possibility should not be excluded of forming the cover 54 in segments separate from one another, to be connected by suitable joining means.

It should be borne in mind, indeed, that in the example of the invention considered heretofore the cover consists of a single portion which surrounds the leg portion 51; as can be seen from FIG. 4, this makes it necessary to introduce the inner shoe 5 into the shell 2, arranging it in such a manner as to fit the upper part of the shell into the sheath defined between the cover and the leg portion.

It can be understood, however, that this operation might be simplified by providing a cover formed of separate segments, to be connected each other in order to constitute the whole cover with suitable joining means such as zip fasteners, strips of Velcro (Regd. trademark) or the like, once the shoe is located inside the shell. In other terms for carrying out the operation shown in FIG. 4, in this case the shoe would have to be introduced at first into the shell with the various segments of the cover left free from one another, and then the latter should be joined together with the zip fasteners or one of the other systems above mentioned, thereby re-establishing the integrity of the cover for the operating condition of the skate.

Finally, also for hinging the cover to the shell the solution provided by the bushes and the screws 60, 61 can easily be changed; among the many possible alternatives, mention will be made here only to press-studs, which are practical to fasten and unfasten, allow rotation between the coupled elements forming them, and are available at low cost.

The possibility should not however be excluded of also adopting, in order to form the hinging system, elements of the Velcro type (Regd. trademark) which although they do not allow true rotation between them, are sufficiently flexible for adapting to the use proposed for this invention.

Consequently, the methods for hinging the cover to the shell should be interpreted sufficiently widely as to include all those connecting systems which make it possible to operate according to the teaching derived from what has been described above.

Analogous considerations to those dealt with hitherto also apply to the second embodiment of the invention, of which FIGS. 7–10 and 11*a*–11*d* give a view similar to that of the preceding case.

For an easier understanding, the parts which correspond structurally or functionally to those already described in connection with the first example of the invention, are indicated by the same reference numbers in the drawings and hereinafter only some of them will be considered in order to explain the more significant differences.

Comparing FIGS. 1–4 and 7–10, it can be seen that the shell 2 of this second skate is no longer in the shape of a complete boot, but rather comprises only the rigid sole 20 fixed to the frame from which the upper part 24 projects in order to form the rear of the shell.

The inner shoe 5 is then visible at the front and its upper 50 is reinforced at the top with a toe-piece 58 and at the rear with a semi-rigid heel 59 of plastics material or other. From the heel 59 there projects a hook-shaped appendage 59*a,* intended to engage with an opening or notch 65 present in the rear of the shell 2 (see FIGS. 10 and 11*a*–11*d*), in order to better secure the shoe 5 to the shell 2. Also, similar to FIGS. 6*a*–6*d*, FIGS. 11*a*–11*d* show the flexibility of shell 2.

Figure 10:
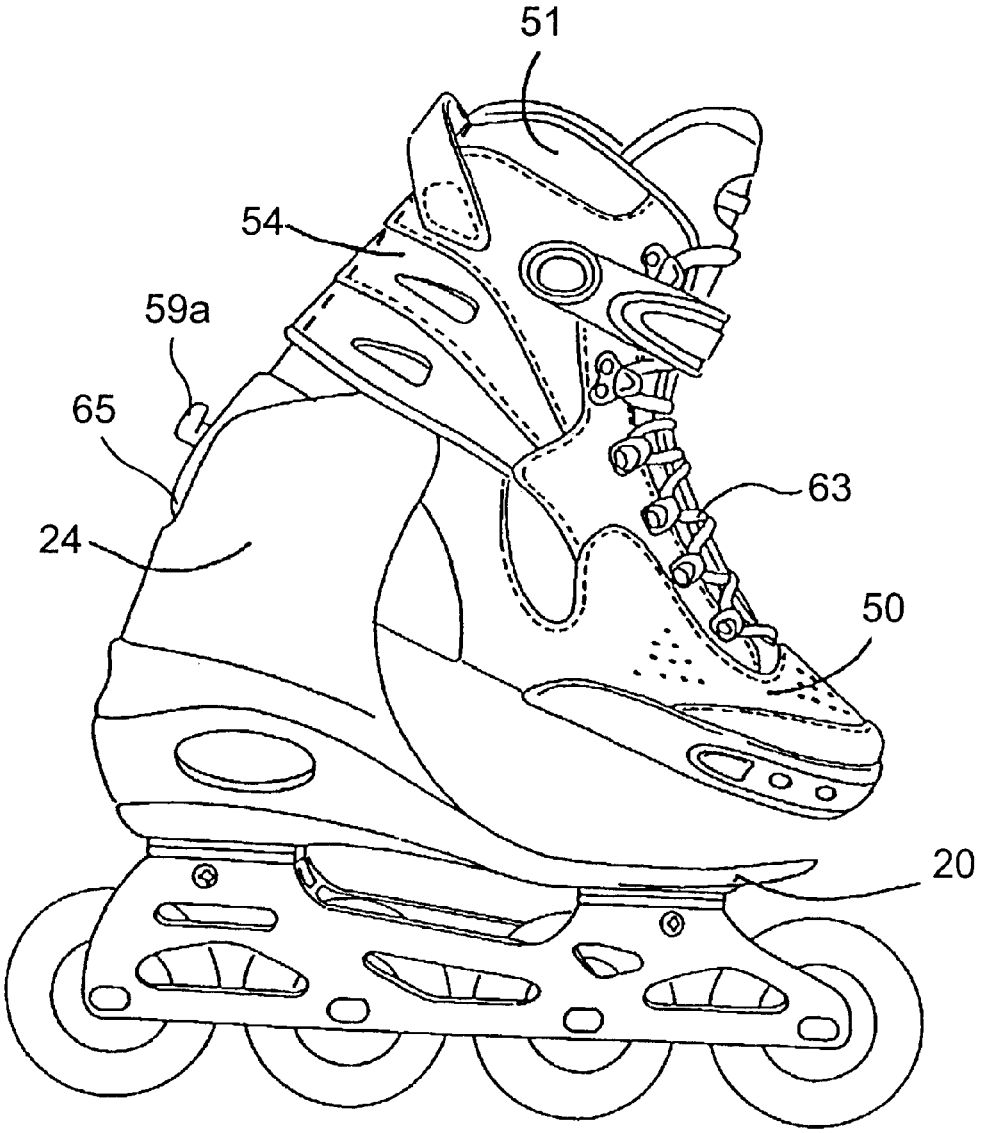
FIG. 10 shows a side view of the coupling of the parts of the skate shown in FIGS. 8 and 9.
Figure 11A:
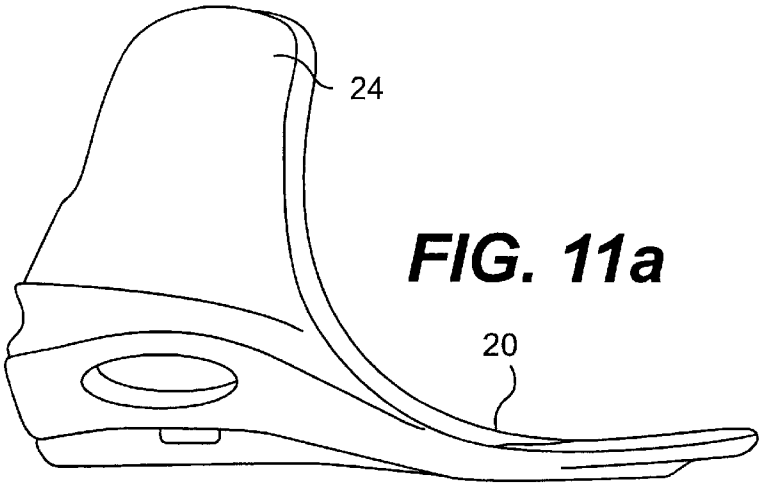
FIGS. 11*a*–11*d* show a skate shell according to another embodiment of the present invention.
Figure 11B:
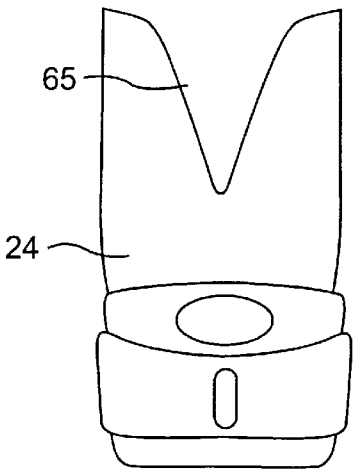
Figure 11C:
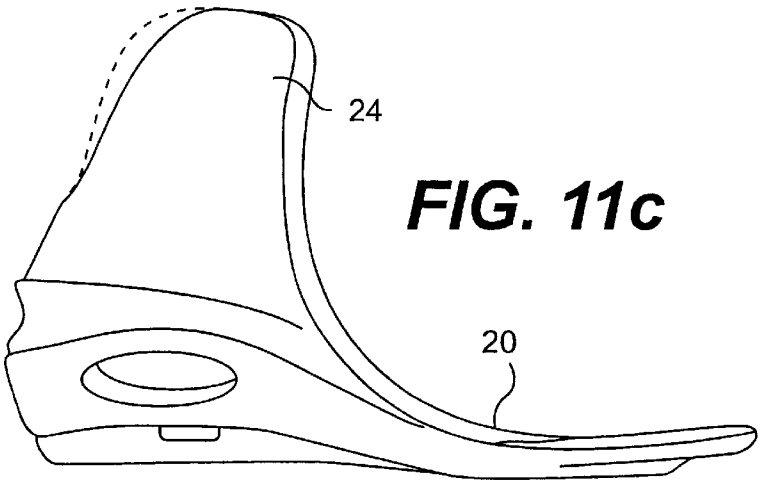
Figure 11D:
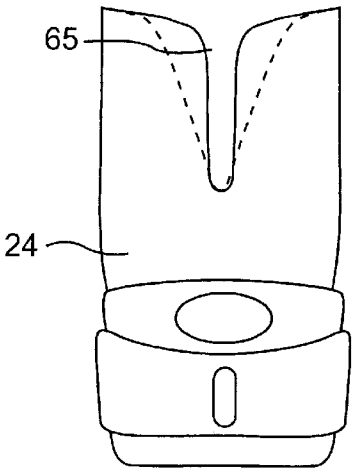

Also in this case the leg portion 51 of the shoe 5 ends with an upper edge 52 and is lined externally by a flexible cover 54, sewn at the top along the junction line 55; as already seen before, between the cover 54 and the outer surface of the leg portion 51 there is defined a sheath for receiving the upper part 24 of the shell 2 (see FIG. 10).

With regard to the functional features and the advantages, as well as the possible variants, of this second embodiment of the invention, for sake of brevity reference should be made to what has been explained previously.

In these circumstances it needs only be added that this second skate is more comfortable than the other; indeed, the fact of having the shoe 5 free at the front, makes it possible to obtain a better ventilation of the foot with all the advantages that derives therefrom; moreover, the elimination of the front part of the shell allows a softer fitting of the foot, since the front of the shoe 5 is now no longer in contact with a rigid casing.

These and further possible variants are included however in the scope of the claims which follow.

What is claimed is:

1. In-line roller skate, comprising a frame on which the wheels are mounted, a substantially rigid outer shell fitted onto the frame and including an upper part arranged round the ankle or at least the rear thereof, a flexible inner shoe provided with a leg portion and arranged within the shell, wherein the leg portion of the flexible shoe is lined externally with a cover (54) secured to it so as to define with the exterior of the leg portion a sheath, which is substantially open downward and in which the upper part of the shell is housed.

2. The skate according to claim 1, wherein the cover is hinged to the shell in opposed positions with respect to a longitudinal plane of the skate passing through the in-line wheels.

3. The skate according to claim 2, wherein the cover is hinged in the malleolar regions of a foot housed in the skate.

4. The skate according to claim 2, wherein the hinging of the cover to the shell is made by means of screw-threaded bushes and screws.

5. The skate according to claim 2, wherein the hinging of the cover is made by means of press-studs.

6. The skate according to claim 1, wherein the cover is secured upward to the leg portion along a line which extends at the upper edge of the leg portion.

7. The skate according to any one of the preceding claims, wherein the shell is substantially shaped as a boot which encloses the flexible inner shoe.

8. The skate according to any one of claim 1, wherein the shell is shaped so as to be present substantially only in the rear region thereby leaving the flexible inner shoe exposed at the front.

* * * * *